US007118443B2

(12) United States Patent
Marine et al.

(10) Patent No.: US 7,118,443 B2
(45) Date of Patent: Oct. 10, 2006

(54) ANIMATED MULTI-PERSONA TOY

(75) Inventors: Jon C. Marine, Fullerton, CA (US); Tara McGrath, Hermosa Beach, CA (US); Joyce Mesch, Hamburg, NY (US); Kevin W. Gray, Thousand Oaks, CA (US); Ok-Soo Choi, Los Angeles, CA (US)

(73) Assignee: Mattel, Inc., Emeryville, CA (US)

( * ) Notice: Subject to any disclaimer, the term of this patent is extended or adjusted under 35 U.S.C. 154(b) by 33 days.

(21) Appl. No.: 10/672,957

(22) Filed: Sep. 25, 2003

(65) Prior Publication Data

US 2004/0152394 A1 Aug. 5, 2004

Related U.S. Application Data

(60) Provisional application No. 60/423,237, filed on Oct. 31, 2002, provisional application No. 60/414,128, filed on Sep. 27, 2002.

(51) Int. Cl.
*A63H 3/00* (2006.01)
*A63H 30/00* (2006.01)
*A63H 3/28* (2006.01)

(52) U.S. Cl. ..... 446/268; 446/175; 446/297

(58) Field of Classification Search ..... 446/297–303, 446/321, 99–100, 268, 356, 353–355, 352, 446/330

See application file for complete search history.

(56) References Cited

U.S. PATENT DOCUMENTS 3,284,947 A * 11/1966 Dahl ..... 446/374
3,538,638 A * 11/1970 Glass et al. ..... 446/302
3,755,960 A * 9/1973 Tepper et al. ..... 446/299
D261,162 S 10/1981 Ohkawa
4,547,169 A 10/1985 Maxim
4,579,541 A * 4/1986 Kulesza et al. ..... 446/304
4,717,364 A 1/1988 Furukawa
4,799,678 A 1/1989 Terzian et al.
4,808,142 A 2/1989 Berliner
4,850,930 A 7/1989 Sato et al.
5,011,449 A * 4/1991 Handy et al. ..... 446/297
5,029,214 A 7/1991 Hollander
5,074,821 A 12/1991 McKeefery et al.
5,158,492 A 10/1992 Rudell et al.
5,191,615 A 3/1993 Aldava et al.
5,209,695 A 5/1993 Rothschild
5,213,510 A 5/1993 Freeman
5,236,385 A 8/1993 May
5,281,143 A 1/1994 Arad et al.
5,281,180 A 1/1994 Lam et al.
5,324,225 A 6/1994 Satoh et al.
5,478,240 A 12/1995 Cogliano
5,493,185 A 2/1996 Mohr et al.
5,501,627 A 3/1996 Ekstein (Continued)

FOREIGN PATENT DOCUMENTS

EP 0 898 237 A2 2/1999

(Continued)

OTHER PUBLICATIONS iCybie robotic dog product specification with picture, 2001.

(Continued)

*Primary Examiner*—Stephen Blau
*Assistant Examiner*—Urszula M. Cegielnik
(74) *Attorney, Agent, or Firm*—Kolisch Hartwell, P.C.

(57) ABSTRACT

The present invention provides animated toys adapted to imitate multiple personas.

38 Claims, 5 Drawing Sheets

U.S. PATENT DOCUMENTS

| | | | | |
|---|---|---|---|---|
| 5,636,994 | A | 6/1997 | Tong | |
| 5,647,787 | A | 7/1997 | Raviv et al. | |
| 5,655,945 | A | 8/1997 | Jani | |
| 5,802,488 | A | 9/1998 | Edatsune | |
| 5,820,441 | A | 10/1998 | Pracas | |
| 5,912,454 | A | 6/1999 | Castillo et al. | |
| D424,625 | S | 5/2000 | Yamazaki | |
| 6,108,515 | A | 8/2000 | Freeman | |
| 6,126,508 | A * | 10/2000 | Chou | 446/358 |
| 6,149,490 | A | 11/2000 | Hampton et al. | |
| 6,160,986 | A | 12/2000 | Gabai et al. | |
| 6,210,249 | B1 * | 4/2001 | Stadlbauer | 446/330 |
| D445,849 | S | 7/2001 | Saito | |
| 6,257,948 | B1 | 7/2001 | Silva | |
| D448,433 | S | 9/2001 | Ueda et al. | |
| 6,366,285 | B1 | 4/2002 | Brush, II et al. | |
| D457,203 | S | 5/2002 | Onishi et al. | |
| 6,394,872 | B1 | 5/2002 | Watanabe et al. | |
| 6,435,936 | B1 | 8/2002 | Rehkemper et al. | |
| 6,514,118 | B1 * | 2/2003 | Bart et al. | 446/321 |
| 2001/0020944 | A1 | 9/2001 | Brown et al. | |
| 2001/0029147 | A1 | 10/2001 | Hornsby et al. | |
| 2001/0041496 | A1 * | 11/2001 | Smirnov | 446/297 |
| 2002/0016128 | A1 | 2/2002 | Saito | |
| 2002/0049606 | A1 | 4/2002 | Dan et al. | |
| 2002/0050802 | A1 | 5/2002 | Inoue et al. | |
| 2002/0052672 | A1 | 5/2002 | Osawa | |
| 2002/0078363 | A1 | 6/2002 | Hill et al. | |
| 2002/0089297 | A1 | 7/2002 | Filo | |
| 2002/0103576 | A1 | 8/2002 | Takamura et al. | |
| 2002/0106964 | A1 * | 8/2002 | Gaynor et al. | 446/330 |
| 2002/0128746 | A1 | 9/2002 | Boies et al. | |

FOREIGN PATENT DOCUMENTS

| | | | |
|---|---|---|---|
| EP | 1 122 038 | A1 | 8/2001 |
| EP | 1 136 193 | A2 | 9/2001 |
| EP | 1 151 779 | A2 | 11/2001 |
| EP | 1 155 786 | A1 | 11/2001 |
| EP | 1 195 231 | A1 | 4/2002 |
| EP | 1 197 251 | A2 | 4/2002 |
| EP | 1 207 487 | A1 | 5/2002 |
| JP | 62-157598 | | 7/1987 |
| WO | WO 200211843 | A1 * | 2/2002 |

OTHER PUBLICATIONS

My Real Baby product information by Hasbro and iRobot, Nov. 2000.

Sony AIBO 31L 6 10 2002, "Sony's new robotic dog doesn't have enough bite for the buck" article, by Mike Langberg, Mercury News.

Sony AIBO Robot Dog information from the website "robotbooks.com".

Tomy Dog Com robotic Dog article, May 2001.

Toby Terrier by Tiger Electronics website article, © 2001 VEIL Interactive Technologies.

* cited by examiner

ANIMATED MULTI-PERSONA TOY

CROSS-REFERENCE TO RELATED APPLICATIONS

This application claims priority under 35 U.S.C. 119(e) to U.S. Provisional Patent Application Ser. No. 60/414,128 entitled "Animated Multi-Persona Toy," filed Sep. 27, 2002; and U.S. Provisional Patent Application No. 60/423,237 entitled "Animated Multi-Persona Toy," filed Oct. 31, 2002, the disclosures of which are herein incorporated by reference.

BACKGROUND

The present invention relates generally to animated toys, and more particularly to those toys adapted to imitate multiple personas.

In recent years animation in children's toys has become very popular. Animated toys may include a system for generating motion, typically driven by small rotating motors that connect to gears, pulleys, or levers. Some animation systems also include electronics for controlling the animation, and for controlling speech. Examples of such toys, including those that imitate common household pets such as dogs, cats, or dragons, are disclosed in U.S. Pat. Nos. 4,808,142; 4,850,930; 4,900,289; 4,923,428; 5,074,821; 5,281,180; 5,324,225; 5,501,627; 5,636,994; 5,655,945; 5,802,488; 5,912,454; 6,149,490; and 6,322,420; and U.S. patent application Ser. Nos. 20020016128 and 20020078363. The disclosures of each of those patents and patent applications are herein incorporated by reference.

SUMMARY

The present invention provides animated toys adapted to imitate multiple personas. The advantages of the present invention will be understood more readily after a consideration of the drawings and the Detailed Description of the Preferred Embodiment.

DETAILED DESCRIPTION OF THE PREFERRED EMBODIMENT

Figure 1:
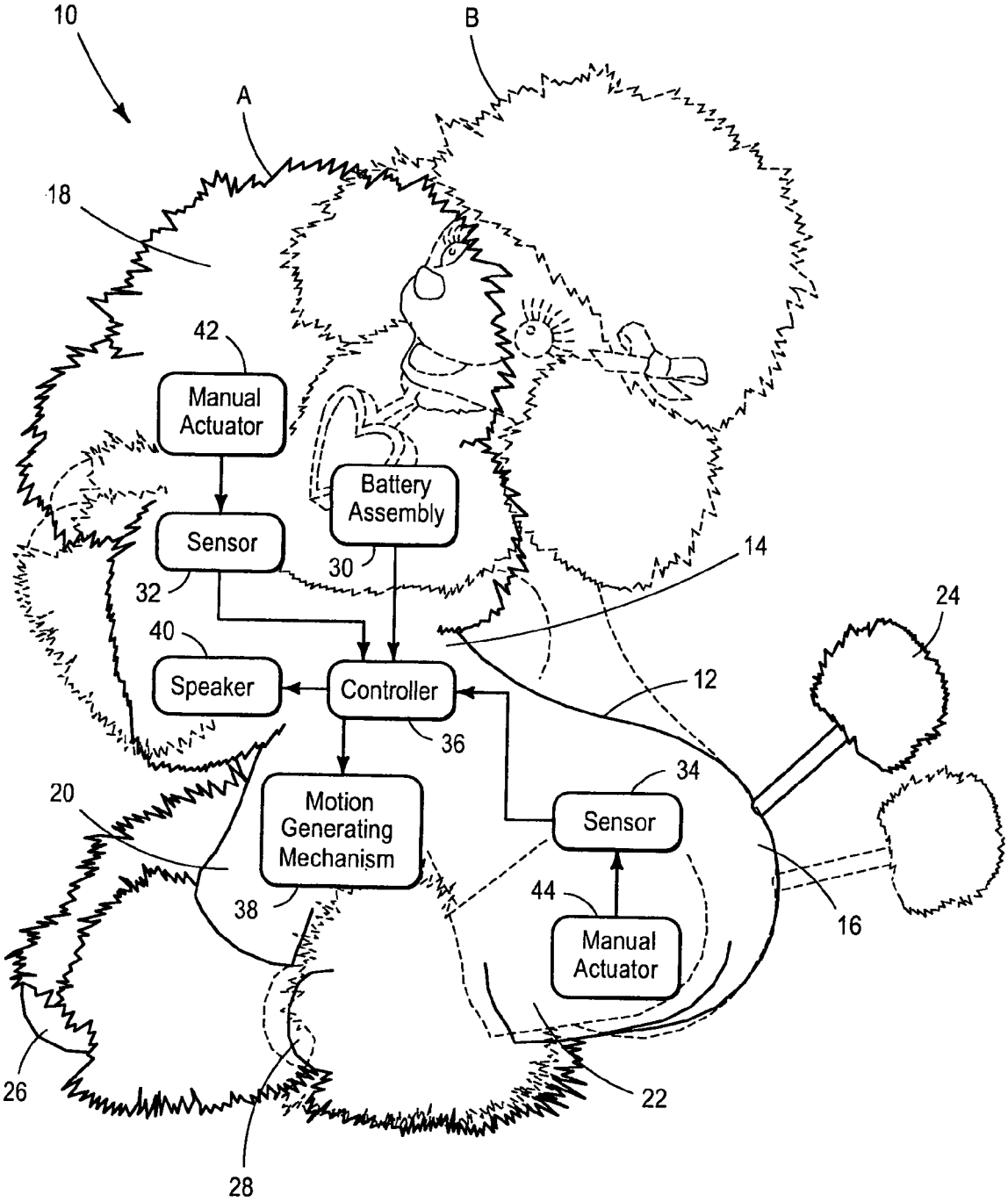
FIG. 1 is a side view of a multi-persona toy in first and second positions, including a schematic representation of its major components.

Referring to FIG. 1, a toy constructed according to the present invention is indicated generally at 10, and preferably resembles a pet. Toy 10 may be manipulated into a plurality of positions, including a first position A and a second position B. Preferably, first position A is a sitting position and second position B is an upright position. In first position A, toy 10 preferably imitates a first persona, while in second position B, toy 10 preferably imitates a second persona. The ability to manipulate toy 10 into a plurality of positions may allow the user to manually select the desired persona.

Toy 10 may include a body or torso 12 including an anterior end 14 and a posterior end 16. Body 12 may include a head 18 and may have appendages, including front legs 20, hind legs 22, and a tail 24, all of which may be rotatably connected to body 12. Preferably, head 18 and front legs 20 are adjacent to anterior end 14, and hind legs 22 and tail 24 are adjacent to posterior end 16. Head 18 may include eyes, ears, nose, and mouth to provide the external appearance of a pet and/or human. Front legs 20 may include front feet 26, and hind legs 22 may include hind feet 28.

Internal components of toy 10 are represented schematically in FIG. 1, which may include a battery assembly 30, sensors 32 and 34, a controller 36, a motion-generating mechanism 38, and a speaker 40. Preferably, those internal components allow toy 10 to interact with users via sensors 32 and 34 and imitate multiple personas via motion-generating mechanism 38 and speaker 40.

Battery assembly 30 generally includes any portion of toy 10 configured or adapted to provide electrical power, including electrical power for the sensors, controller, motion-generating mechanism, and speaker. Battery assembly 30 may be incorporated in body 12 and/or head 18. Preferably, battery assembly 30 is incorporated in head 18.

Sensors 32 and 34 generally include any portion of toy 10 configured or adapted to provide inputs to controller 36. Sensors 32 and 34 may include touch, positional, light, audio, and/or other suitable sensors. In addition, sensors 32 and 34 may be incorporated in body 12 and/or head 18.

Sensors 32 and 34 may be actuated by various manual actuators 42 and 44. Manual actuators 42 and 44 allow users to activate sensors 32 and 34, respectively. Manual actuators 42 and 44 may include push buttons, cords, levers, or any other suitable actuators. In addition, manual actuators 42 and 44 may be incorporated in front legs 20, hind legs 22, and/or tail 24, such that movement of those body parts in manipulating toy 10 from first position A to second position B, from second position B to first position A, and/or various other positions, activates sensors 32 and 34. Moreover, manual actuators 42 and 44 may be located on body 12 and/or head 18. Additional sensors and manual actuators also may be included and incorporated in and/or located on body 12, head 18, front legs 20, hind legs 22, and/or tail 24. Preferably, toy 10 includes a touch sensor with manual actuator and a positional sensor with manual actuator in body 12, and a light sensor and two touch sensors in head 18.

Controller 36 generally includes any portion of toy 10 configured or adapted to receive inputs from sensors 32 and 34 and direct the motion-generating mechanism 38 and/or provide audio output via speaker 40. Controller 36 may include a control program (not shown) that processes inputs from sensors 32 and 34 and outputs animation through motion-generating mechanism 38 and/or audio through speaker 40. Controller 36 may be incorporated in body 12 and/or head 18. Preferably, controller 36 is incorporated in head 18.

Motion-generating mechanism 38 generally includes any portion of toy 10 configured or adapted to move various parts of toy 10, including head 18, front legs 20, hind legs 22, and/or tail 24, and/or various combinations of those parts. In addition, motion-generating mechanism 38 may move other parts of toy 10, such as eyelids, eyes, ears, nose, and mouth on head 18, and various combinations of those parts. Preferably, hind legs 22 are not driven by motion-generating mechanism 38 to allow manual manipulation of toy 10 into different positions, including first position A, second position B, and/or other positions. Moreover, motion-generating mechanism 38 may be incorporated in body 12 and/or head 18. Preferably, motion-generating mechanism 38 is incorporated in head 18.

Speaker 40 generally includes any portion of toy 10 configured or adapted to provide audio output consistent with multiple personas. Speaker 40 may be incorporated in body 12 and/or head 18. Preferably, speaker 40 is incorporated in body 12.

Figure 2:
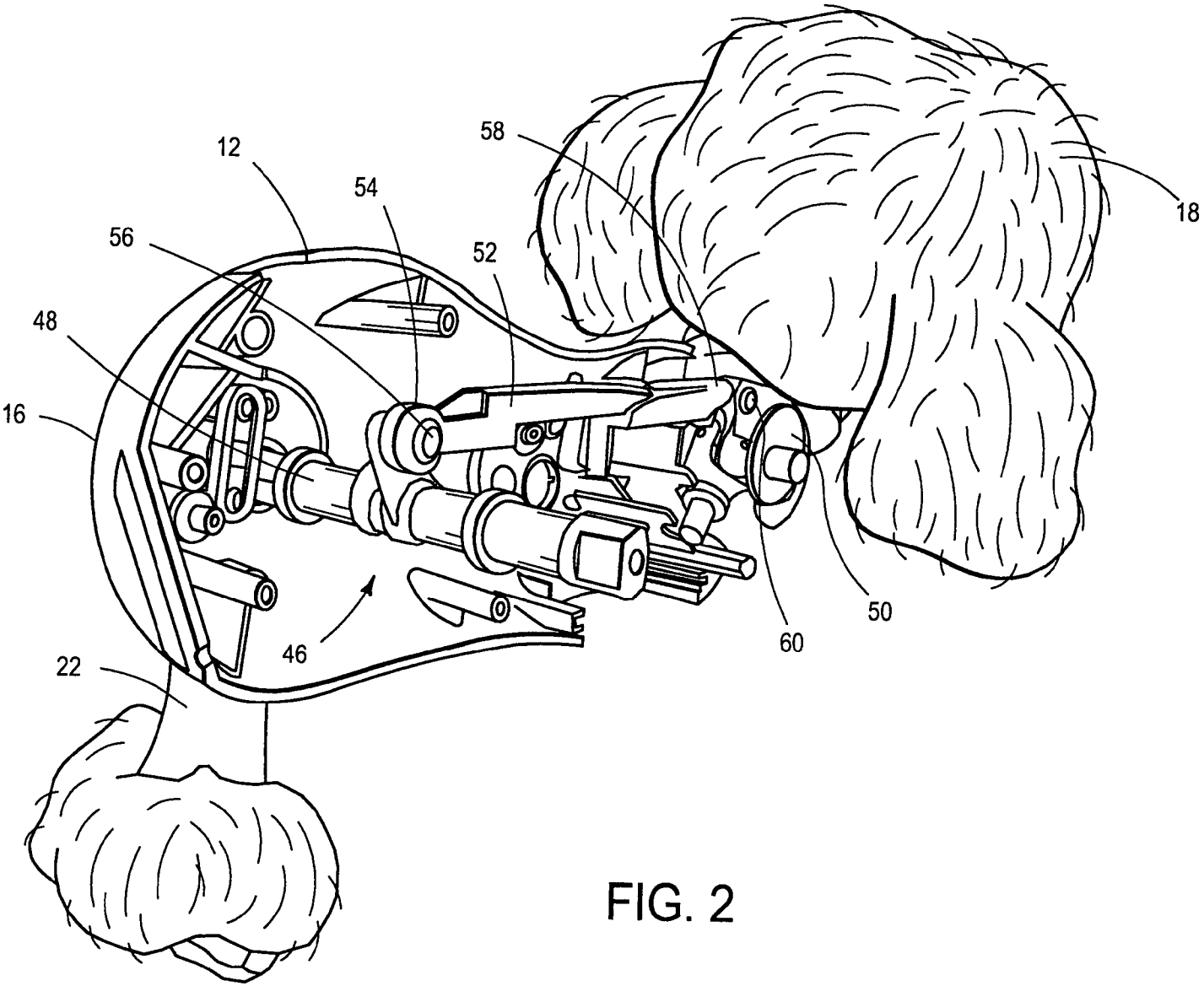
FIG. 2 is an exploded view of the body of the toy shown in FIG. 1, including a leg assembly that rotatably connects the head and hind legs of the toy.

Referring to FIG. 2, body 12 also may include a leg assembly 46. Leg assembly 46 generally includes any portion of toy 10 configured or adapted to movably connect head 18 to hind legs 22, such that moving head 18 moves hind legs 22, and/or moving hind legs 22 moves head 18. Leg assembly 46 may include a first pivot member 48, a second pivot member 50, and a connecting rod 52. First pivot member 48 is connected to hind legs 22 and is configured or adapted to allow hind legs 22 to be moved to different positions. First pivot member 48 may be in the form of a rotating shaft or any suitable form. Second pivot member 50 is connected to head 18 and is configured or adapted to allow head 18 to be moved to different positions. Second pivot member 50 may be in the form of a rotating shaft or any suitable form.

Connecting rod 52 may include a first end 54, a first fastener 56, a second end 58, and a second fastener 60. Connecting rod 52 is movably connected to first pivot member 48 on first end 54 by first fastener 56. Similarly, connecting rod 52 is movably connected to second pivot member 50 on second end 58 by second fastener 60. Connecting rod 52 may be shaped to conform to body 12 or any suitable form. First fastener 56 and second fastener 60 may be in the form of screws, pins, bolts, or any suitable fastener.

Leg assembly 46 may be configured or adapted to maintain head 18 at an approximately fixed angle relative to a support plane regardless of the position of hind legs 22. For example, posterior end 16 of body 12 may define a support plane (not shown) and leg assembly 46 may be configured or adapted to always maintain head 18 to an approximately level orientation relative to that support plane whether toy 10 is in first position A, second position B, or any other position.

Alternatively, front legs 20 may also be connected to leg assembly 46 by connecting third pivot member via third fastener (both not shown) to connecting rod 52 such that head 18, front legs 20, and hind legs 22 move in unison. In another embodiment, leg assembly 46 may be configured or adapted to movably connect head 18 to front legs 20, such that moving head 18 moves front legs 20, and/or moving front legs 20 moves head 18. In still another embodiment, a second leg assembly (not shown) may be configured or adapted to maintain head 18 at an approximately fixed angle relative to a horizontal support plane regardless of the position of front legs 20.

Figure 3:
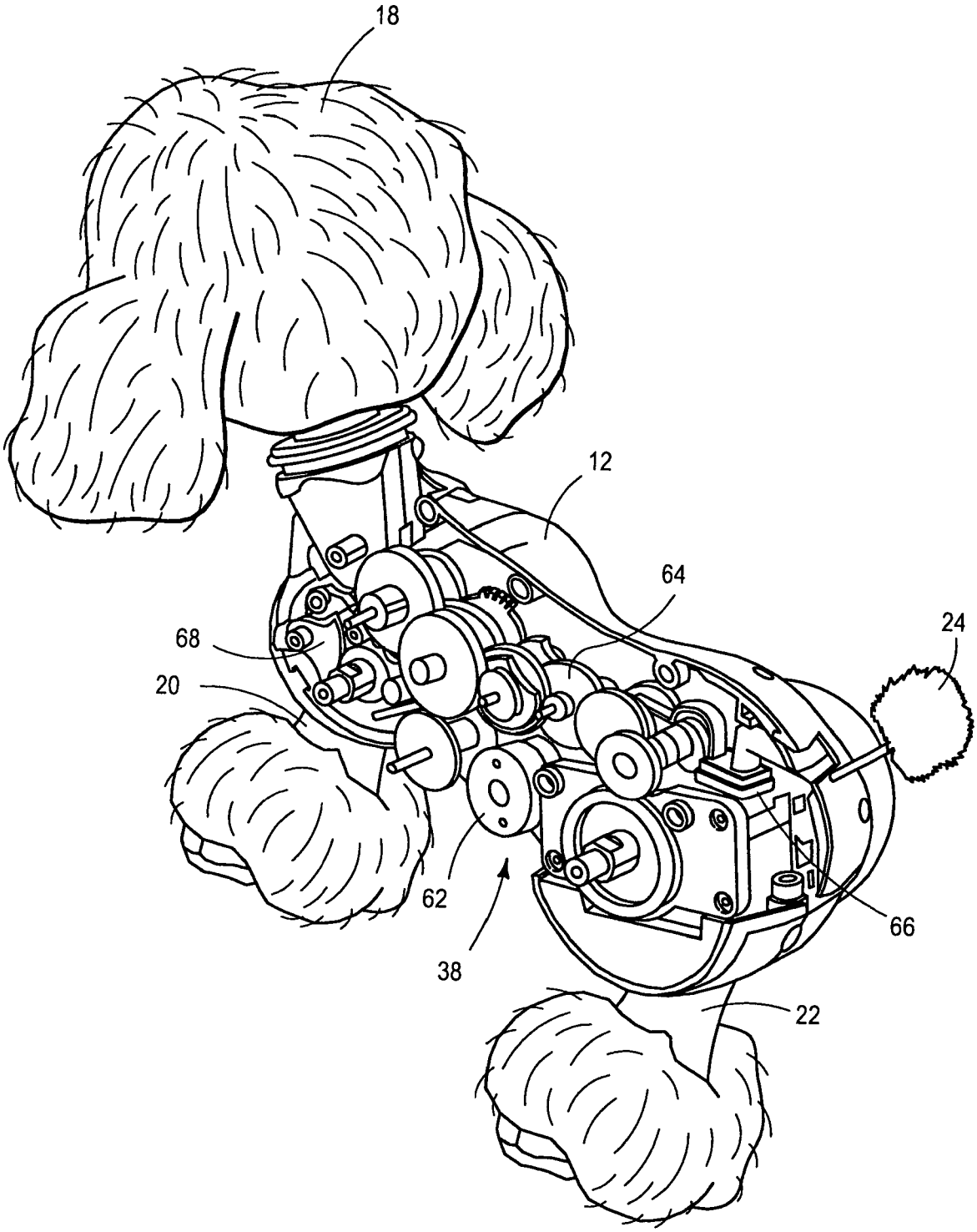
FIG. 3 is an exploded view of the body of the toy shown in FIG. 1, including a motion generating mechanism that moves various parts of the toy.

Referring to FIG. 3, motion-generating mechanism 38 may include a motor 62, a gear train 64, engagement members 66 and 68. Motor 62 is configured or adapted to move gear train 64. Motor 62 may be any suitable motor. Gear train 64 is configured or adapted to move engagement members 66 and 68. Gear train 64 may include various gears, cams, levers, pulleys, and other suitable components.

Engagement members 66 and 68 are configured or adapted to move head 18, front legs 20, hind legs 22, and/or tail 24, and various combinations of those parts. Engagement members 66 and 68 may also be configured or adapted to move other parts of toy 10, such as eyelids, eyes, ears, nose, and mouth on head 18, and various combinations of those parts. Engagement members 66 and 68 may in the form of shafts, arms, and other suitable forms. Additional engagement members (not shown) may be provided to move additional parts of toy 10.

In addition, a rotary encoder (not shown) may be attached to gear train 64 and may rotate 360° or less between the extremes. The rotary encoder may provide periodic feedback to controller 36 to verify position of the driven elements of toy 10, including head 18, front legs 20, hind legs 22, and/or tail 24, and/or various combinations of those parts.

Moreover, toy 10 may include a hard shell (not shown) to protect internal components discussed below, and outer coverings, such as fur, to provide the external appearance of a pet. Furthermore, accessories (not shown) may be provided with toy 10 to increase user interactivity with toy 10. Those accessories may include hairclips, brushes, powder puffs, sticker sheets, bracelets, and simulated pet and human food.

Figure 4:
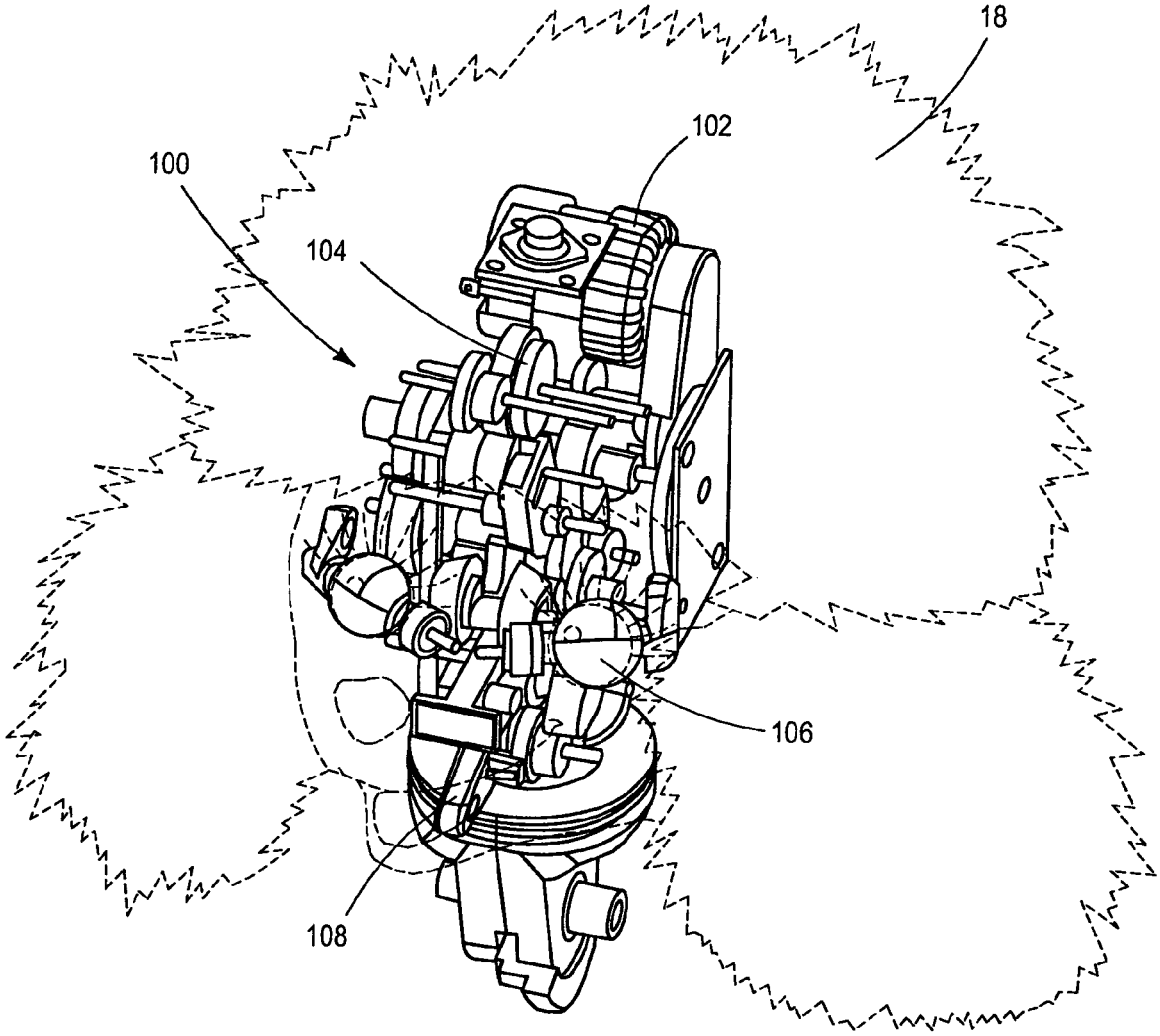
FIG. 4 is an exploded view of the head of another embodiment of the toy shown in FIG. 1, including a motion generating mechanism that moves various parts of the toy.

In another embodiment shown in FIG. 4, head 18 may have an additional motion-generating mechanism 100 incorporated therein, which is configured or adapted to move various parts of toy 10. Preferably, motion-generating mechanism 100 moves the parts associated with head 18. Motion-generating mechanism 100 may include a motor 102, a gear train 104, and engagement members 106 and 108. Motor 102 is configured or adapted to move gear train 104. Motor 102 may be any suitable motor. Gear train 104 is configured or adapted to move engagement members 106 and 108. Gear train 104 may include various gears, cams, levers, pulleys, and other suitable components.

Engagement members 106 and 108 are configured or adapted to move head 18 and may also be configured or adapted to move other parts of toy 10, such as eyelids, eyes, ears, nose, and mouth on head 18, and various combinations of those parts. Engagement members 106 and 108 may in the form of shafts, arms, and other suitable forms. Additional engagement members (not shown) may be provided to move additional parts of toy 10.

In addition, a rotary encoder (not shown) may be attached to gear train 104 and may rotate 360° or less between the extremes. The rotary encoder may provide periodic feedback to controller 36 to verify position of the driven elements of toy 10, including head 18, and other parts of toy 10, such as eyelids, eyes, ears, nose, and mouth on head 18, and/or various combinations of those parts.

Figure 5:
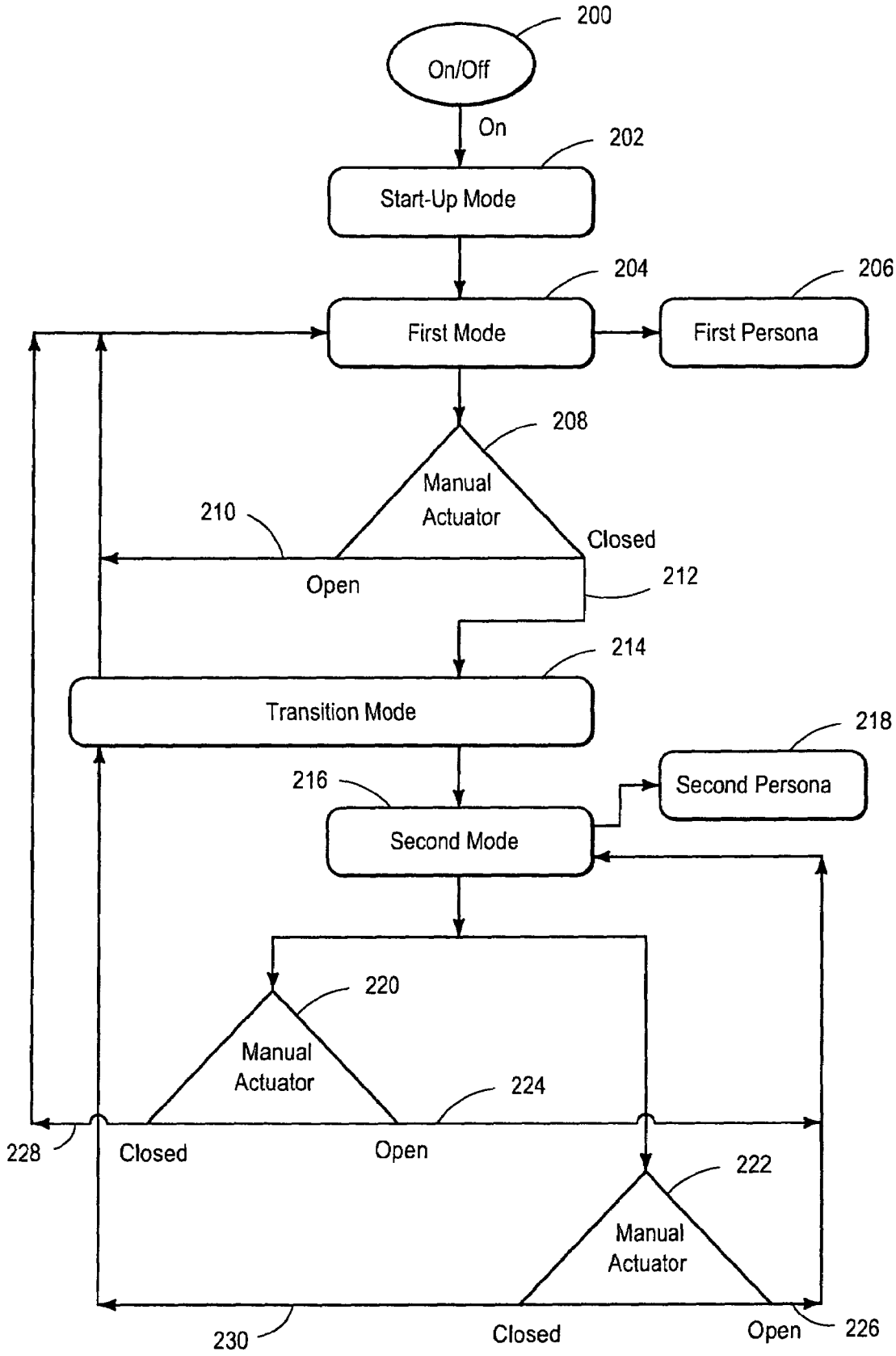
FIG. 5 is a schematic representation of an interactive feature of the toy shown in FIG. 1 showing different modes of interactivity.

FIG. 5 shows interactive features of toy 10. Toy 10 may include an on/off switch 200. On/off switch 200 may be incorporated in body 12 or head 18. Preferably, on/off switch is incorporated in head 18. When on/off switch 200 is switched on, toy 10 may go to a start-up mode 202.

Start-up mode 202 may include controller 36 directing motion-generating mechanism 38 and/or providing audio output to speaker 40 to imitate multiple personas. In addition, controller 36 may receive inputs from sensors 32 and 34 and produce suitable outputs through motion-generating mechanism 38 and/or speaker 40. Start-up mode 202 may end based on a fixed length of time elapsing from when on/off switch 200 was first switched on, specific inputs from sensors 32 and 34, specific outputs from controller 36, and/or other suitable criteria. Preferably, start-up mode ends after controller 36 has produced specific outputs through motion-generating mechanism 38 and speaker 40.

After start-up mode 200 ends, toy 10 preferably goes into a first mode 204. Alternatively, toy 10 may go directly into first mode 204 when on/off switch 200 is switched on without initially going to start-up mode 202. First mode 204 may include controller 36 directing motion-generating mechanism 38 and/or providing audio output to speaker 40 to imitate a first persona 206. Preferably, first persona 206 imitates a pet. In addition, controller 36 may receive inputs from sensors 32 and 34 and produce suitable first persona 206 outputs through motion-generating mechanism 38 and speaker 40. For example, patting toy 10 on head 18 activates sensor 32 sending input to controller 36, which in turn directs motion-generating mechanism to move head 18 and/or tail 24, and produces audio output via speaker 40 to imitate first persona 206 reacting to a pat on head 18.

In addition, first mode 204 may include a standby phase (not shown) if sensors 36 or 38 are not activated within a fixed period of time. In the standby phase, controller 36 waits until either sensor 32 or 34 is activated again before it produces suitable first persona 206 outputs through motion-generating mechanism 38 and/or speaker 40. Controller 36 may provide specific first persona 206 outputs to indicate that toy 10 is going into standby phase. For example, controller 36 may provide audio output to speaker 40 that toy 10 is going into standby phase. First mode 204 may end based on a predetermined length of time elapsing from when first mode 204 started, specific inputs from sensors 32 and 34, specific outputs from controller 36, and/or other suitable criteria.

Preferably, a manual actuator 208 determines whether toy 10 remains in first mode 204. When manual actuator 208 is not activated or remains open, then an open node 210 keeps toy 10 in first mode 204. In contrast, when manual actuator 208 is activated or closed, then a closed node 212 takes toy 10 into a transition mode 214. Alternatively, additional manual actuators (not shown) may be provided to determine if toy 10 remains in first mode 204. In another embodiment, toy 10 goes directly from first mode 204 to second mode 216 without initially going to transition mode 214.

Transition mode 214 may include controller 36 directing motion-generating mechanism 38 and/or providing audio output to speaker 40 to imitate multiple personas. In addition, controller 36 may receive inputs from sensors 32 and 34 and produce suitable outputs through motion-generating mechanism 38 and/or speaker 40. Transition mode 214 may end based on a predetermined length of time elapsing from when transition mode 214 started, specific inputs from sensors 32 and 34, specific outputs from controller 36, and/or other suitable means. Preferably, transition mode 214 ends after controller 36 has produced specific outputs through motion-generating mechanism 38 and speaker 40.

After transition mode 214 ends, toy 10 may go to a second mode 216. Second mode 216 may include controller 36 directing motion-generating mechanism 38 and/or providing audio output to speaker 40 to imitate a second persona 218. Preferably, second persona 218 imitates a human. In addition, controller 36 may receive inputs from sensors 32 and 34 and produce suitable second persona 218 outputs through motion-generating mechanism 38 and/or speaker 40. For example, toy 10 may invite user via speaker 40 to scratch head 18. When user scratches head 18, that scratch activates sensor 32 sending input to controller 36, which in turn directs motion-generating mechanism to move head 18 and/or tail 24, and produces audio output via speaker 40 to imitate second persona 218 thanking the user for scratching head 18.

In addition, second mode 216 may include a standby phase (not shown) if sensors 32 and 34 are not activated within a fixed period of time. In the standby phase, controller 36 waits until either sensor 32 or 34 is activated again before it produces suitable second persona 218 outputs through motion-generating mechanism 38 and/or speaker 40. Controller 36 may provide specific second persona 218 outputs to indicate that toy 10 is going into standby phase. For example, controller 36 may provide audio output to speaker 40 that toy 10 is going into standby phase. Second mode 216 may end based on a predetermined length of time elapsing from when friend mode 204 started, specific inputs from sensors 32 and 34, specific outputs from controller 36, and/or other suitable criteria. Alternatively, additional modes imitating additional personas (not shown) may be provided.

Preferably, a manual actuator 220 or a manual actuator 222 determines whether toy 10 remains in second mode 216. If both manual actuator 220 and manual actuator 222 are not activated or remain open, then open nodes 224 and 226, respectively, keep toy 10 in the friend mode. In contrast, if either manual actuator 220 or manual actuator 222 is activated or closed, then closed nodes 228 and 230, respectively, takes toy 10 into first mode 204. In the preferred embodiment, closed node 228 takes toy 10 directly to first mode 204, whereas closed node 230 takes toy 10 initially into transition mode 214 before going to first mode 204. Alternatively, both closed nodes 228 and 230 may take toy 10 directly to dog mode or take toy 10 initially into transition mode 214 before going to first mode 204. Additional manual actuators (not shown) may be provided that determine whether toy 10 remains in second mode 216. In another embodiment, only manual actuator 222 determines whether toy 10 remains in second mode 216.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of the invention.

We claim:

1. A multi-persona toy, comprising:

a body adapted to function in a plurality of modes, including a first mode imitating a first persona, and a second mode imitating a second persona;

a manual actuator adapted to change a function of the body between the first mode and the second mode;

at least one appendage rotatably connected and adapted to move relative to the body, wherein the manual actuator is incorporated in the at least one appendage, and the manual actuator is actuated by moving the at least one appendage from a first position to a second position, wherein the body includes a posterior end, the at least one appendage includes a leg adjacent to the posterior end, and the leg includes a foot, and further wherein the leg is able to be rotated to assume a plurality of rotational positions relative to the body;

a support plane defined by the posterior end of the body and the foot, wherein the support plane is adapted to rest on a surface, and wherein for each rotational position of the at least one appendage, the body is able to be maintained in a different position relative to the support plane;

a head mounted on the body; and a lever assembly connecting the at least one appendage to the head, wherein for each rotational position of the at least one appendage, the lever assembly is adapted to hold the head in a different position relative to the body and maintains the head in an approximately level orientation relative to the support plane.

2. The multi-persona toy of claim 1, wherein the lever assembly connects the leg to the head.

3. A multi-persona toy, comprising:

a body;

at least one sensor, including at least one transition sensor;

a controller adapted to function in a plurality of modes, including:

a first mode, wherein the controller receives an input from the at least one sensor and produces an output that causes the body to imitate a first persona;

a second mode, wherein the controller receives an input from the at least one sensor and produces an output that causes the body to imitate a second persona;

a transition mode, wherein the controller receives an input from the at least one transition sensor and produces an output that converts the toy between the first mode and the second mode;

at least one manual actuator that activates the at least one transition sensor; and at least one appendage rotatably connected and adapted to move relative to the body, wherein:

the at least one manual actuator is incorporated in the at least one appendage, and the at least one transition sensor is activated by moving the at least one appendage from a first position to a second position wherein the body includes a posterior end, the at least one appendage includes a leg adjacent to the posterior end, and the leg includes a foot; and further wherein the leg is able to be rotated to assume a plurality of rotational positions relative to the body.

4. The multi-persona toy of claim 3, wherein the at least one manual actuator is incorporated in the leg and the at least one transition sensor is activated by moving the leg from a first position to a second position.

5. The multi-persona toy of claim 3, further comprising a support plane defined by the posterior end of the body and the foot, wherein the support plane is adapted to rest on a surface, and wherein for each rotational position of the at least one appendage, the body is able to be maintained in a different position relative to the support plane;

a head mounted on the body; and a lever assembly connecting the at least one appendage to the head, wherein for each rotational position of the at least one appendage, the lever assembly is adapted to hold the head in a different position relative to the body and maintains the head in an approximately level orientation relative to the support plane.

6. The multi-persona toy of claim 5, wherein the lever assembly connects the leg to the head.

7. A multi-persona toy, comprising:

a body;

at least one appendage rotatably connected and adapted to move relative to the body;

at least one sensor, including at least one transition sensor;

at least one motion generating mechanism adapted to control movement of the at least one appendage;

a speaker;

a controller adapted to function in a plurality of modes, including:

a first mode, wherein the controller receives an input from the at least one sensor and produces an output signal that drives the at least one motion generating mechanism and generates audio output through the speaker causing the body to imitate a first persona;

a second mode, wherein the controller receives an input from the at least one sensor and produces an output signal that drives the at least one motion generating mechanism and generates audio output through the speaker causing the body to imitate a second persona;

a transition mode, wherein the controller receives an input from the at least one transition sensor and produces output that converts the toy between the first mode and the second mode; and at least one manual actuator that activates the at least one transition sensor, wherein the at least one motion generating mechanism includes a first motion generating mechanism and a second motion generating mechanism, and the at least one sensor includes a first sensor and a second sensor; and further wherein:

the controller receives input from the first sensor and produces an output signal that drives the first motion generating mechanism and generates audio output through the speaker, and the controller receives an input from the second sensor and produces output signal that drives the second motion generating mechanism and generates audio output through the speaker.

8. The multi-persona toy of claim 7, wherein the at least one manual actuator includes a first manual actuator and a second manual actuator; and further wherein:

the first manual actuator activates the first sensor providing an input signal to the controller, the controller then produces an output signal that drives the first motion generating mechanism and generates audio output through the speaker, and the second manual actuator activates the second sensor providing an input signal to the controller, the controller then produces an output signal that drives the second motion generating mechanism and generates audio output through the speaker.

9. A multi-persona toy, comprising:

a body;

at least one appendage rotatably connected and adapted to move relative to the body;

at least one sensor, including at least one transition sensor;

at least one motion generating mechanism adapted to control movement of the at least one appendage:

a speaker;

a controller adapted to function in a plurality of modes, including:

a first mode, wherein the controller receives an input from the at least one sensor and produces an output signal that drives the at least one motion generating mechanism and generates audio output through the speaker causing the body to imitate a first persona;

a second mode, wherein the controller receives an input from the at least one sensor and produces an output signal that drives the at least one motion generating mechanism and generates audio output through the speaker causing the body to imitate a second persona;

a transition mode, wherein the controller receives an input from the at least one transition sensor and produces output that converts the toy between the first mode and the second mode; and at least one manual actuator that activates the at least one transition sensor, wherein the at least one manual actuator is incorporated in the at least one appendage and the at least one transition sensor is activated by moving the at least one appendage from a first position to a second position.

10. A multi-persona toy, comprising:

a body, wherein the body includes a posterior end;

at least one appendage rotatably connected and adapted to move relative to the body, the at least one appendage includes a leg adjacent to the posterior end and the leg includes a foot, the leg is able to by rotated to assume a plurality of rotational positions relative to the body;

at least one sensor, including at least one transition sensor;

at least one motion generating mechanism adapted to control movement of the at least one appendage;

a speaker;

a controller adapted to function in a plurality of modes, including:

a first mode, wherein the controller receives an input from the at least one sensor and produces an output signal that drives the at least one motion generating mechanism and generates audio output through the speaker causing the body to imitate a first persona;

a second mode, wherein the controller receives an input from the at least one sensor and produces an output signal that drives the at least one motion generating mechanism and generates audio output through the speaker causing the body to imitate a second persona;

a transition mode, wherein the controller receives an input from the at least one transition sensor and produces output that converts the toy between the first mode and the second mode; and at least one manual actuator that activates the at least one transition sensor a support plane defined by the posterior end of the body and the foot, wherein the support plane is adapted to rest on a surface, and wherein for each rotational position of the at least one appendage, the body may be maintained in a different position relative to the support plane;

a head mounted on the body; and a lever assembly connecting the at least one appendage to the head, wherein for each rotational position of the at least one appendage, the lever assembly is adapted to hold the head in a different position relative to the body and maintains the head in an approximately level orientation relative to the support plane.

11. The multi-persona toy of claim 10, wherein the lever assembly connects the leg to the head.

12. A multi-persona toy, comprising:

a body;

at least one appendage rotatably connected and adapted to move relative to the body;

at least one sensor, including at least one transition sensor;

at least one motion generating mechanism adapted to control movement of the at least one appendage;

a speaker;

a controller adapted to function in a plurality of modes, including:

a first mode, wherein the controller receives an input from the at least one sensor and produces an output signal that drives the at least one motion generating mechanism and generates audio output through the speaker causing the body to imitate a first persona;

a second mode, wherein the controller receives an input from the at least one sensor and produces an output signal that drives the at least one motion generating mechanism and generates audio output through the speaker causing the body to imitate a second persona;

a transition mode, wherein the controller receives an input from the at least one transition sensor and produces output that converts the toy between the first mode and the second mode; and at least one manual actuator that activates the at least one transition sensor, wherein the at least one transition sensor includes a first transition sensor and a second transition sensor, and the at least one manual actuator includes a first manual actuator and a second manual actuator; and further wherein:

the first manual actuator activates the first transition sensor sending an input to the controller, the controller then converts the toy between the first mode to the second mode, and the second manual actuator activates the second transition sensor sending an input to the controller, the controller then converts the toy from the second mode to the first mode.

13. A multi-persona toy, comprising:

a body;

at least one appendage rotatably connected and adapted to move relative to the body;

at least one sensor, including at least one transition sensor;

at least one motion generating mechanism adapted to control movement of the at least one appendage;

a speaker;

a controller adapted to function in a plurality of modes, including:

a first mode, wherein the controller receives an input from the at least one sensor and produces an output signal that drives the at least one motion generating mechanism and generates audio output through the speaker causing the body to imitate a first persona;

a second mode, wherein the controller receives an input from the at least one sensor and produces an output signal that drives the at least one motion generating mechanism and generates audio output through the speaker causing the body to imitate a second persona;

a transition mode, wherein the controller receives an input from the at least one transition sensor and produces output that converts the toy between the first mode and the second mode; and at least one manual actuator that activates the at least one transition sensor, wherein the at least one motion generating mechanism includes at least one motor.

14. A multi-persona toy, comprising:

a body;

at least one appendage rotatably connected and adapted to move relative to the body;

at least one sensor, including at least one transition sensor;

at least one motion generating mechanism adapted to control movement of the at least one appendage;

a speaker;

a controller adapted to function in a plurality of modes, including:

a first mode, wherein the controller receives an input from the at least one sensor and produces an output signal that drives the at least one motion generating mechanism and generates audio output through the speaker causing the body to imitate a first persona;

a second mode, wherein the controller receives an input from the at least one sensor and produces an output signal that drives the at least one motion generating mechanism and generates audio output through the speaker causing the body to imitate a second persona;

a transition mode, wherein the controller receives an input from the at least one transition sensor and produces output that converts the toy between the first mode and the second mode; and at least one manual actuator that activates the at least one transition sensor, wherein the at least one motion generating mechanism includes a rotary encoder.

15. A toy comprising:

a body, including an anterior end and a posterior end;

at least one appendage rotatably connected to the body and adapted to move relative to the body, wherein the at least one appendage includes a first leg adjacent to the anterior end and a second leg adjacent to the posterior end, and further wherein the first leg includes a first foot and the second leg includes a second foot, and the first leg and the second leg is able to be rotated to assume a plurality of rotational positions relative to the body;

a support plane defined by the posterior end of the body and the second foot, wherein the support plane is adapted to rest on a surface, and wherein for each rotational position of the at least one appendage, the body is able to be maintained in a different position relative to the support plane;

a head mounted on the body; and at least one lever assembly connecting the at least one appendage to the head, wherein for each rotational position of the at least one appendage, the at least one lever assembly is adapted to hold the head in a different position relative to the body and maintains the head in an approximately level orientation relative to the support plane.

16. The toy of claim 15, wherein the at least one lever assembly connects the first leg to the head, wherein for each rotational position of the first leg, the at least one lever assembly is adapted to hold the head in a different position relative to the body and maintains the head in an approximately level orientation relative to the support plane.

17. The toy of claim 15, wherein the at least one lever assembly connects the second leg to the head, wherein for each rotational position of the second leg, the at least one lever assembly is adapted to hold the head in a different position relative to the body and maintains the head in an approximately level orientation relative to the support plane.

18. The toy of claim 15, wherein the at least one lever assembly connects the first leg and the second leg to the head, wherein for each rotational position of the first leg and the second leg, the at least one lever assembly is adapted to hold the head in a different position relative to the body and maintains the head in an approximately level orientation relative to the support plane.

19. The toy of claim 15, wherein the at least one lever assembly includes a first lever assembly and a second lever assembly; and further wherein:

the first lever assembly connects the first leg to the head and for each rotational position of the first leg, the first lever assembly is adapted to hold the head in a different position relative to the body, and maintains the head in an approximately level orientation relative to the support plane, and the second lever assembly connects the second leg to the head and for each rotational position of the second leg, the second lever assembly is adapted to hold the head in a different position relative to the body, and maintains the head in an approximately level orientation relative to the support plane.

20. The toy of claim 15, wherein the body is adapted to function in a plurality of modes, including a first mode imitating a first persona, and a second mode imitating a second persona; and includes at least one manual actuator adapted to change a function of the body between the first mode and the second mode.

21. The toy of claim 20, wherein the at least one manual actuator is incorporated in the at least one appendage, and the at least one manual actuator is actuated by moving the at least one appendage from a first position to a second position.

22. The toy of claim 21, wherein the at least one manual actuator is incorporated in the first leg, and the at least one manual actuator is actuated by moving the first leg from a first position to a second position.

23. The toy of claim 21, wherein the at least one manual actuator is incorporated in the second leg, and the at least one manual actuator is actuated by moving the second leg from a first position to a second position.

24. The toy of claim 20, wherein the at least one manual actuator includes a first manual actuator and a second manual actuator; and further wherein the first manual actuator is adapted to convert the toy between the first mode and the second mode, and the second manual actuator is adapted to convert the toy from the second mode to the first mode.

25. The toy of claim 15, further comprising:

at least one sensor, including at least one transition sensor;

a controller adapted to function in a plurality of modes, including:

a first mode, wherein the controller receives an input from the at least one sensor and produces an output that causes the body to imitate a first persona;

a second mode, wherein the controller receives an input from the at least one sensor and produces an output that causes the body to imitate a second persona a transition mode, wherein the controller receives an input from the at least one transition sensor and produces output that converts the toy between the first mode and the second mode; and at least one manual actuator that activates the at least one transition sensor.

26. The toy of claim 25, wherein the at least one manual actuator is incorporated in the at least one appendage and the at least one transition sensor is activated by moving the at least one appendage from a first position to a second position.

27. The toy of claim 26, wherein the at least one manual actuator is incorporated in the first leg, and the at least one manual actuator is actuated by moving the first leg from a first position to a second position.

28. The toy of claim 26, wherein the at least one manual actuator is incorporated in the second leg, and the at least one manual actuator is actuated by moving the second leg from a first position to a second position.

29. The toy of claim 25, wherein the at least one transition sensor includes a first transition sensor and a second transition sensor, and the at least one manual actuator includes a first manual actuator and a second manual actuator; and further wherein:

the first manual actuator activates the first transition sensor sending an input to the controller, the controller then converts the toy between the first mode and the second mode, and the second manual actuator activates the second transition sensor sending an input to the controller, the controller then converts the toy from the second mode to the first mode.

30. The toy of claim 15, further comprising:

at least one sensor, including at least one transition sensor;

at least one motion generating mechanism adapted to control movement of the at least one appendage;

a speaker;

a controller adapted to function in a plurality of modes, including:

a first mode, wherein the controller receives an input from the at least one sensor and produces an output signal that drives the at least one motion generating mechanism and generates audio output through the speaker causing the body to imitate a first persona;

a second mode, wherein the controller receives an input from the at least one sensor and produces an output signal that drives the at least one motion generating mechanism and generates audio output through the speaker causing the body to imitate a second persona a transition mode, wherein the controller receives an input from the at least one transition sensor and produces output that converts the toy between the first mode and the second mode; and at least one manual actuator that activates the at least one transition sensor.

31. The toy of claim 30, wherein the at least one manual actuator is incorporated in the at least one appendage, and the at least one transition sensor is activated by moving the at least one appendage from a first position to a second position.

32. The toy of claim 31, wherein the at least one manual actuator is incorporated in the first leg and the at least one transition sensor is activated by moving the first leg from a first position to a second position.

33. The toy of claim 31, wherein the at least one manual actuator is incorporated in the second leg and the at least one transition sensor is activated by moving the second leg from a first position to a second position.

34. The toy of claim 30, wherein the at least one transition sensor includes a first transition sensor and a second transition sensor, and the at least one manual actuator includes a first manual actuator and a second manual actuator; and further wherein:

the first manual actuator activates the first transition sensor sending an input to the controller, the controller then converts the toy between the first mode to the second mode, and the second manual actuator activates the second transition sensor sending an input to the controller, the controller then converts the toy from the second mode to the first mode.

35. The toy of claim 30, wherein the at least one motion generating mechanism includes at least one motor.

36. The toy of claim 30, wherein the at least one motion generating mechanism includes a rotary encoder.

37. The toy of claim 30, wherein the at least one motion generating mechanism includes a first motion generating mechanism and a second motion generating mechanism; the at least one sensor includes a first sensor and a second sensor; and further wherein:

the controller receives input from the first sensor and produces an output signal that drives the first motion generating mechanism and generates audio output through the speaker, and the controller receives an input from the second sensor and produces output signal that drives the second motion generating mechanism and generates audio output through the speaker.

38. The toy of claim 37, wherein the at least one manual actuator includes a first manual actuator and a second manual actuator; and further wherein:

the first manual actuator activates the first sensor providing an input signal to the controller, the controller then produces an output signal that drives the first motion generating mechanism and generates audio output through the speaker, and the second manual actuator activates the second sensor providing an input signal to the controller, the controller then produces an output signal that drives the second motion generating mechanism and generates audio output through the speaker.

* * * * *